US010406839B2

(12) United States Patent
Hoshi

(10) Patent No.: US 10,406,839 B2
(45) Date of Patent: Sep. 10, 2019

(54) PRINTER

(71) Applicant: SATO HOLDINGS KABUSHIKI KAISHA, Tokyo (JP)

(72) Inventor: Kazuyuki Hoshi, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/759,331

(22) PCT Filed: Aug. 28, 2017

(86) PCT No.: PCT/JP2017/030686
§ 371 (c)(1),
(2) Date: Mar. 12, 2018

(87) PCT Pub. No.: WO2018/051769
PCT Pub. Date: Mar. 22, 2018

(65) Prior Publication Data

US 2019/0070874 A1 Mar. 7, 2019

(30) Foreign Application Priority Data

Sep. 13, 2016 (JP) ..... 2016-178454
Sep. 13, 2016 (JP) ..... 2016-178456
(Continued)

(51) Int. Cl.
*B41J 25/34* (2006.01)
*B41J 2/335* (2006.01)
(Continued)

(52) U.S. Cl.
CPC ..... *B41J 25/34* (2013.01); *B41J 2/32* (2013.01); *B41J 2/335* (2013.01); *B41J 3/4075* (2013.01); *B41J 29/13* (2013.01)

(58) Field of Classification Search
CPC ... B41J 2/32; B41J 25/34; B41J 25/304; B41J 2/335; B41J 29/13; B41J 3/4075
See application file for complete search history.

(56) References Cited

U.S. PATENT DOCUMENTS 5,565,905 A 10/1996 Kajiya et al.
7,399,130 B2 * 7/2008 Hirte ..... B41J 2/32 347/197
(Continued)

FOREIGN PATENT DOCUMENTS

JP 57-088131 U 5/1982
JP 07-256977 A 10/1995
(Continued)

OTHER PUBLICATIONS

Computer-generated translation of JP 2006-334952, published on Dec. 2006 (Year: 2006).*
(Continued)

*Primary Examiner* — Huan H Tran
(74) *Attorney, Agent, or Firm* — Foley & Lardner LLP

(57) ABSTRACT

A printer includes a thermal head, a connecting part capable of being connected to and disconnected from the thermal head, and a moving mechanism joined with the connecting part, the moving mechanism moving the connecting part to connect and disconnect the thermal head and the connecting part.

40 Claims, 16 Drawing Sheets

(30) Foreign Application Priority Data

Dec. 19, 2016 (JP) ..... 2016-245498
Dec. 19, 2016 (JP) ..... 2016-245500

(51) Int. Cl.

| | |
|---|---|
| ***B41J 3/407*** | (2006.01) |
| ***B41J 29/13*** | (2006.01) |
| ***B41J 2/32*** | (2006.01) |

(56) References Cited

U.S. PATENT DOCUMENTS

| | | | | |
|---|---|---|---|---|
| 8,068,127 | B2 | 11/2011 | Ochiai et al. | |
| 8,564,633 | B2 | 10/2013 | Matsushima et al. | |
| 8,610,752 | B2 | 12/2013 | Tsugaru | |
| 2001/0005216 | A1 | 6/2001 | Takahashi et al. | |
| 2003/0146968 | A1 | 8/2003 | Milton | |
| 2012/0212562 | A1* | 8/2012 | Tsugaru | B41J 2/32 347/222 |
| 2018/0186155 | A1* | 7/2018 | Hoshi | B41J 2/32 |
| 2019/0039393 | A1* | 2/2019 | Hoshi | B41J 2/32 |
| 2019/0070874 | A1* | 3/2019 | Hoshi | B41J 2/335 |
| 2019/0126636 | A1* | 5/2019 | Hoshi | B41J 2/33505 |
| 2019/0126645 | A1* | 5/2019 | Hoshi | B41J 11/04 |

FOREIGN PATENT DOCUMENTS

| | | | | |
|---|---|---|---|---|
| JP | 2003-220722 | A | 8/2003 | |
| JP | 2006-334952 | A | 12/2006 | |
| JP | 2007-136931 | * | 6/2007 | B41J 29/13 |
| JP | 2007-136931 | A | 6/2007 | |
| JP | 2012-171114 | A | 9/2012 | |
| JP | 2014-133364 | A | 7/2014 | |
| WO | WO-2018/051767 | A1 | 3/2018 | |
| WO | WO-2018/051770 | A1 | 3/2018 | |
| WO | WO-2018/051771 | A1 | 3/2018 | |

OTHER PUBLICATIONS

U.S. Appl. No. 15/759,061, filed Mar. 9, 2018, Kazuyuki Hoshi et al.
U.S. Appl. No. 15/759,337, filed Mar. 12, 2018, Kazuyuki Hoshi et al.
U.S. Appl. No. 15/759,383, filed Mar. 12, 2018, Kazuyuki Hoshi et al.
U.S. Appl. No. 15/907,890, filed Feb. 28, 2018, Kazuyuki Hoshi et al.
U.S. Appl. No. 29/638,654, filed Feb. 28, 2018, Kazuyuki Hoshi et al.
U.S. Appl. No. 29/659,475, filed Aug. 9, 2018, Yasuhide et al.
Google translation of JP 2007-136931, published on Jun. 2007, 5 pages.
USPTO Notice of Allowance, U.S. Appl. No. 15/759,061, dated Jan. 24, 2019, 15 pages.
Human English Translation of JP 2006-334952, 39 pages.
USPTO Office Action, U.S. Appl. No. 15/759,337, dated Apr. 10, 2019, 11 pages.
USPTO Office Action, U.S. Appl. No. 15/759,383, dated Apr. 12, 2019, 12 pages.
USPTO Office Action, U.S. Appl. No. 15/759,061, dated May 7, 2019, 14 pages.
USPTO Notice of Allowance, U.S. Appl. No. 15/759,337, dated Jul. 15, 2019, 9 pages.

* cited by examiner

PRINTER

BACKGROUND OF THE INVENTION

The present invention relates to a printer.

A thermal printer prints information on labels typically, and includes a thermal head. Since the thermal head is a consumable, it needs replacing.

Conventionally a technique of facilitating the replacement of a thermal head has been known (see Patent Document 1: Laid open patent publication JP 2014-133364 A).

Patent Document 1 discloses a thermal print head and a print head holder. When a user applies a force to the print head holder, the print head holder is deformed. After deforming the print head holder, the user holds the thermal print head with a hand and attaches the thermal print head to the print head holder.

SUMMARY OF THE INVENTION

When a user attaches the thermal print head to the print head holder of Patent Document 1, the user has to hold the thermal print head with a hand while applying a force to the print head holder. If the user applies a large force to the print head holder, the print head holder or the thermal print head may break.

Especially users of a thermal printer are often unfamiliar with the replacement of a thermal head. For such users, the replacement of a thermal head is a heavy burden.

In other words, it is difficult for a user to replace a thermal head of Patent Document 1.

The present subject matter aims to facilitate the replacement of a thermal head.

According to one of an aspect of the present invention, a printer, comprising:

a thermal head;

a connecting part capable of being connected to and disconnected from the thermal head; and a moving mechanism joined with the connecting part, the moving mechanism moving the connecting part to connect and disconnect the thermal head and the connecting part.

Advantageous Effect of the Present Invention

According to one aspect of the present invention, the replacement of a thermal head may be facilitated.

DETAILED DESCRIPTION OF THE INVENTION

Figure 1:
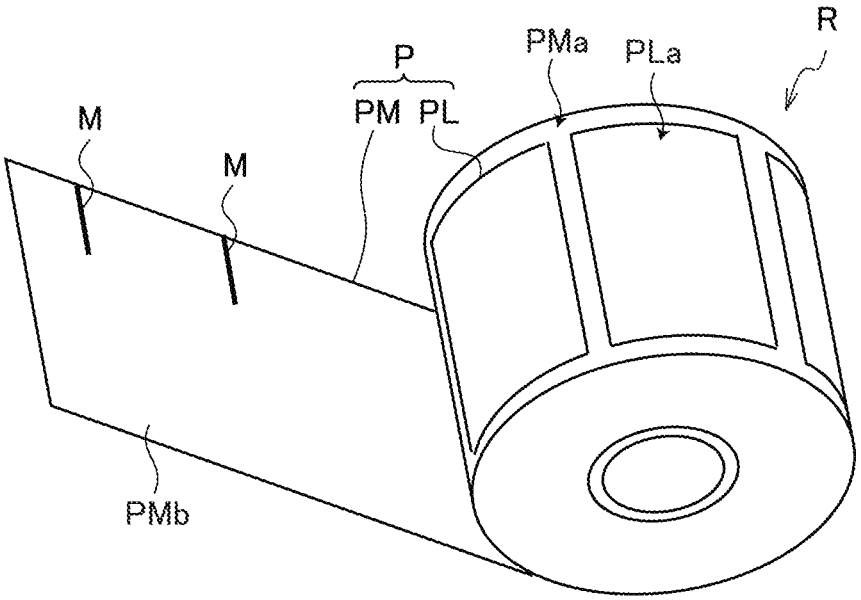
FIG. 1 schematically describes a print medium of the present embodiment.

The following describes the present embodiment.

The following describes one embodiment of the present invention in details, with reference to the drawings. In the drawings describing the embodiment, like numbers indicate like components, and their repeated description is omitted.

In the following description, "FR" refers to the front of a printer and "RR" refers to the rear of the printer.

"UP" refers to the upward when the printer is placed on a horizontal plane, and "LO" refers to the downward when the printer is placed on a horizontal plane.

"LH" and "RH" refer to the direction (hereinafter called a "width direction") orthogonal to the front-rear direction and the up-down direction of the printer.

A part of the printer closer to the container than any referential position on the feed path is refers to the part located "upstream in the feeding direction". A part of the printer closer to the ejection port than the referential position is refers to the part located "downstream in the feeding direction".

(1) Print Medium

The following describes a print medium of the present embodiment. FIG. 1 schematically describes a print medium of the present embodiment.

As shown in FIG. 1, a print medium P of the present embodiment includes a liner PM and a plurality of labels PL.

The liner PM includes a temporary-adhesive face PMa and a non temporary-adhesive face PMb on the other side of the temporary-adhesive face PMa.

The plurality of labels PL temporarily adheres to the temporary-adhesive face PMa at predetermined intervals.

On the non temporary-adhesive face PMb, reference marks M are formed at predetermined intervals. A reference mark M shows the reference position for a label PL.

Each label PL has a print surface PLa and a sticking surface PLb (not illustrated).

The print surface PLa includes a thermosensitive layer that develops a color by heat.

On the sticking surface PLb, adhesive is applied.

(2) Configuration of Printer

Figure 2:
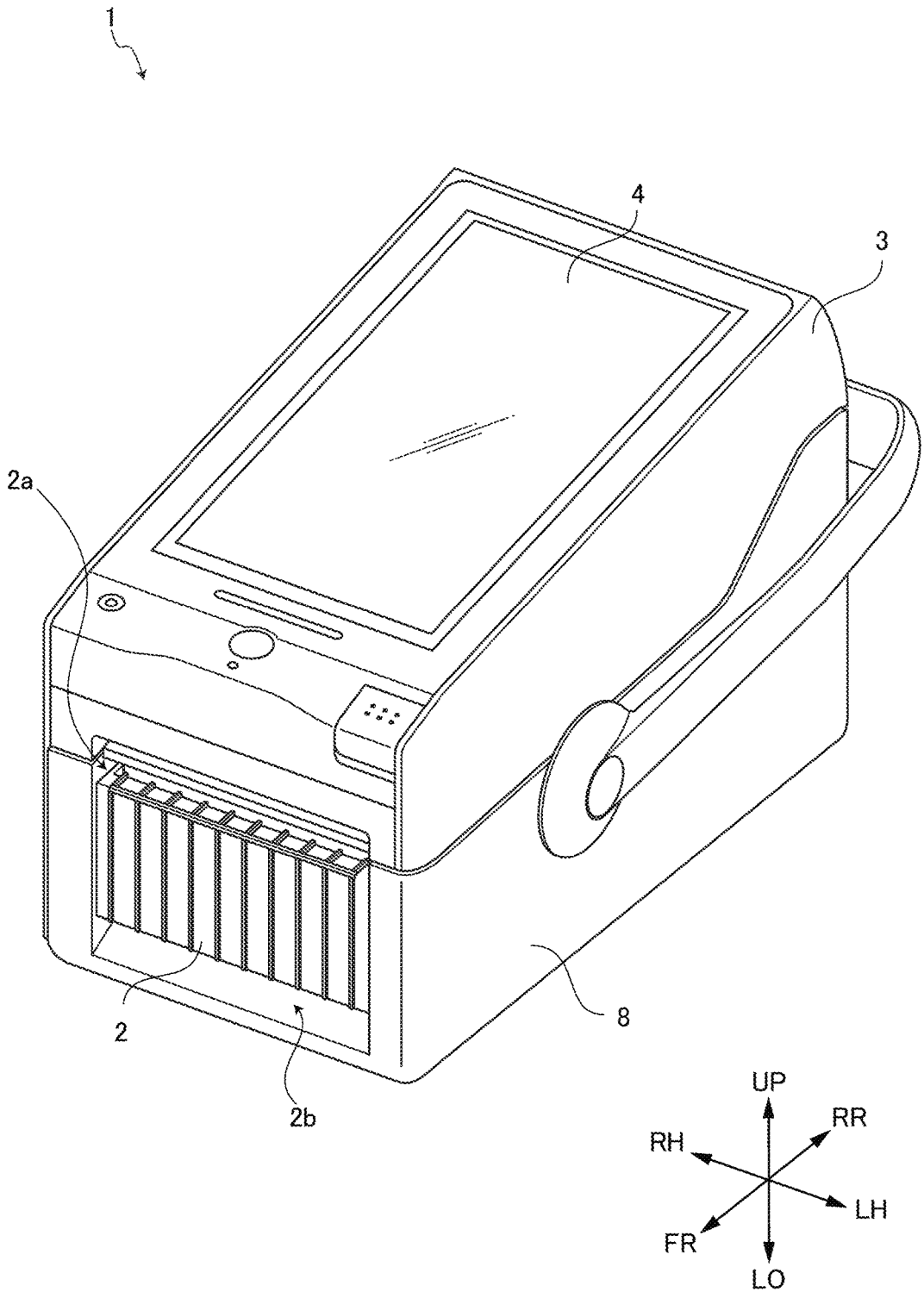
FIG. 2 is a perspective view of a printer of the present embodiment when the printer cover is at a closed position.
Figure 3:
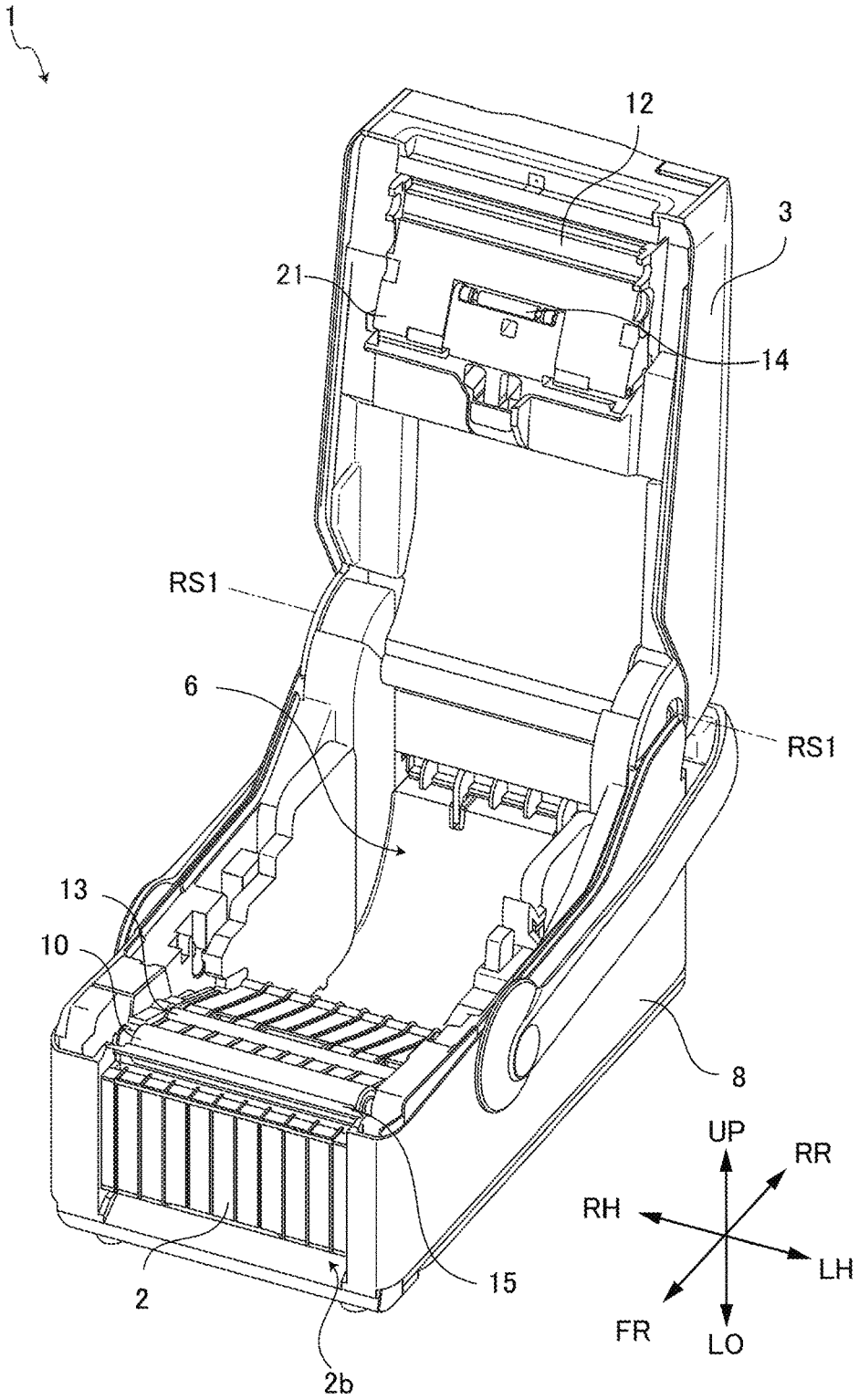
FIG. 3 is a perspective view of the printer of the present embodiment when the printer cover is at an open position and the head cover is at a closed position.
Figure 4:
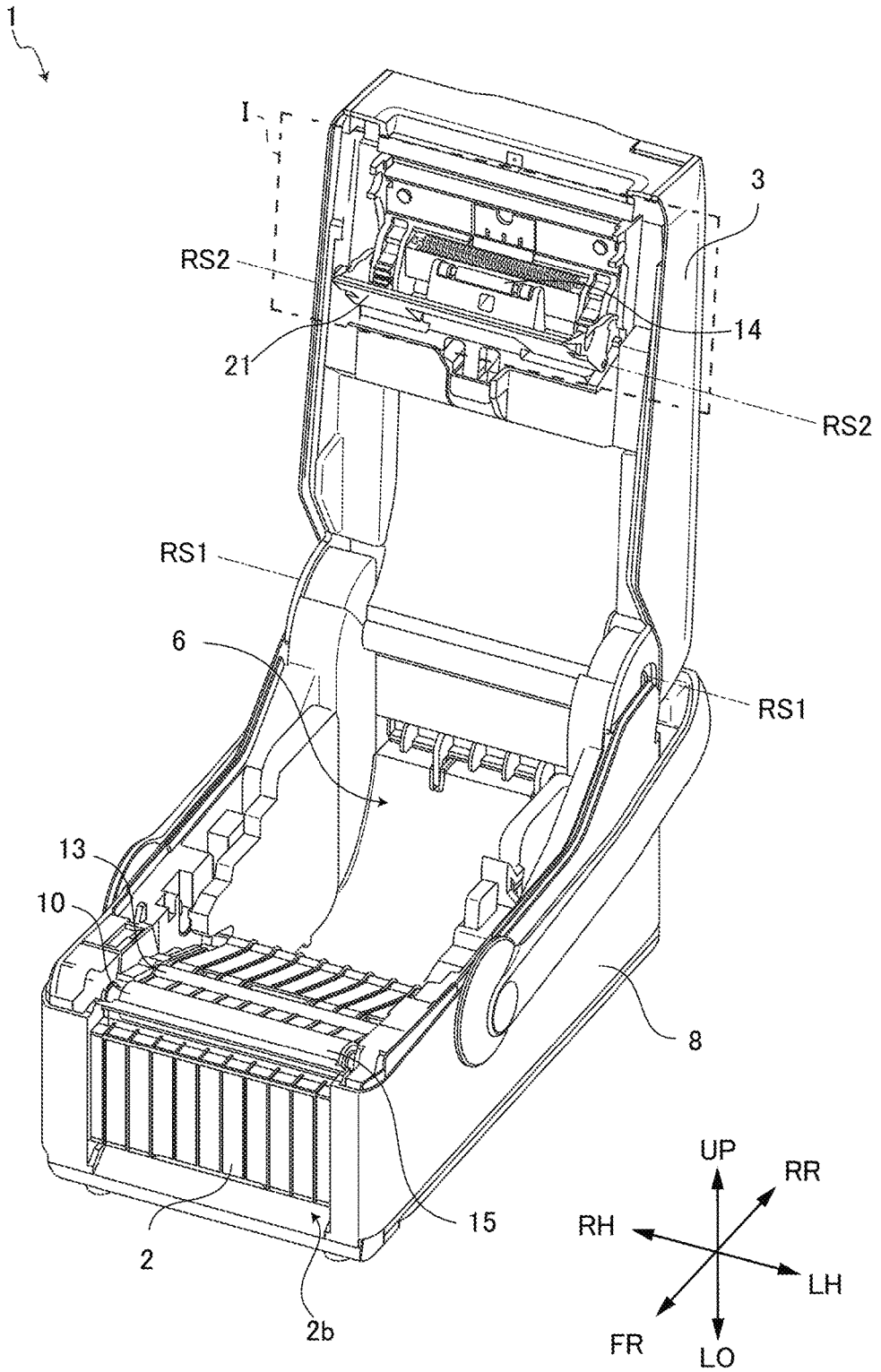
FIG. 4 is a perspective view of the printer of the present embodiment when the printer cover is at an open position and the head cover is at an open position.
Figure 5:
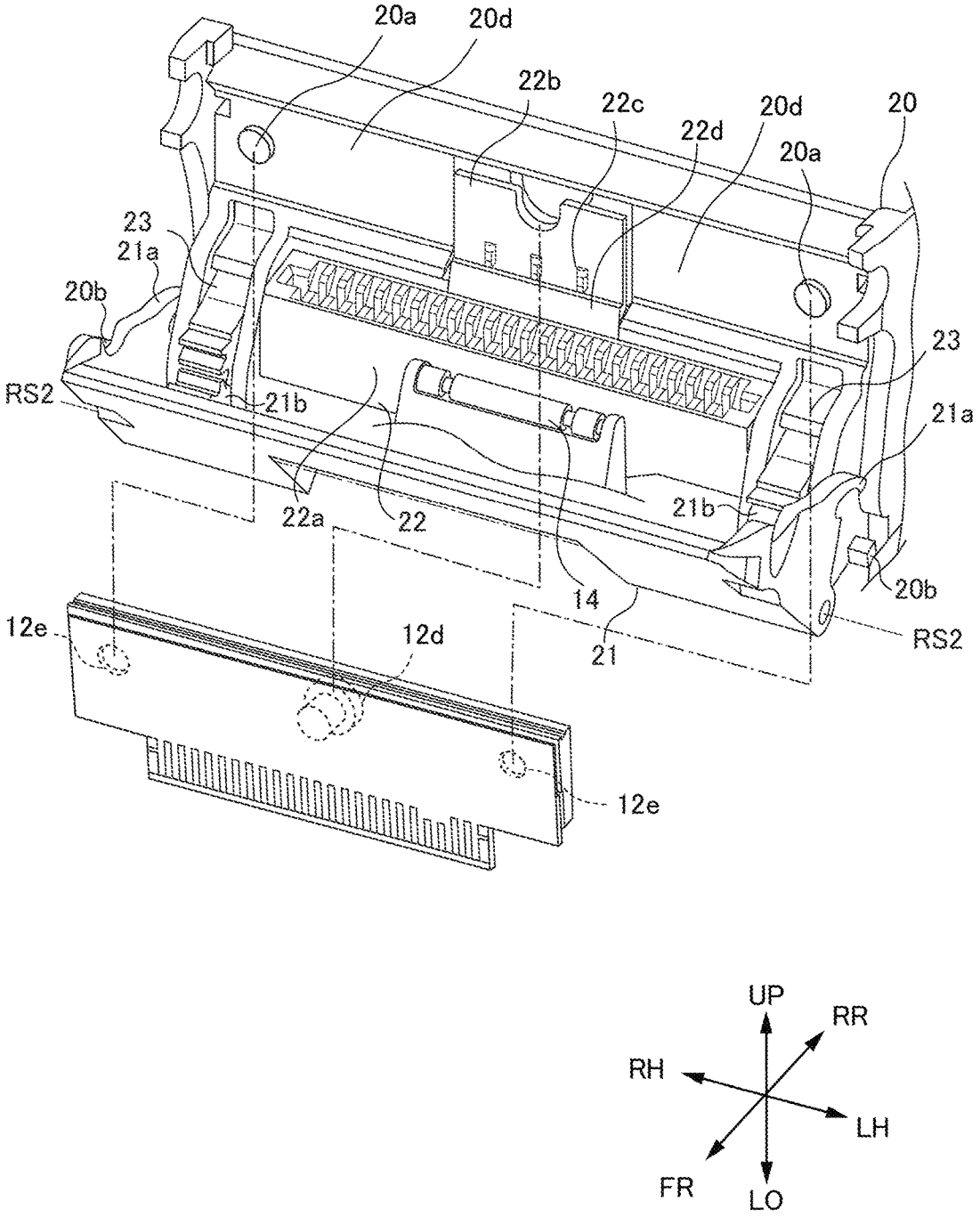
FIG. 5 is an enlarged perspective view of region I of FIG. 4.

The following describes the configuration of a printer of the present embodiment. FIG. 2 is a perspective view of a printer of the present embodiment when the printer cover is at a closed position. FIG. 3 is a perspective view of the printer of the present embodiment when the printer cover is at an open position and the head cover is at a closed position. FIG. 4 is a perspective view of the printer of the present embodiment when the printer cover is at an open position and the head cover is at an open position. FIG. 5 is an enlarged perspective view of region I of FIG. 4. FIG. 6 shows a major part of a connector unit of FIG. 5. FIG. 7 is a perspective view of a major part of a thermal head of FIG. 5. FIG. 8 is a side view of the major parts of the head bracket of FIG. 5, the connector unit of FIG. 6, and the thermal head of FIG. 7.

As shown in FIGS. 2 to 4, the printer 1 includes a front panel 2, a housing 8, a printer cover 3, a touch panel display 4, a container 6, a platen roller 10, a thermal head 12, a first assisting roller 13, a second assisting roller 14, a separator 15, and a head cover 21 (one example of an operation member).

A rear end of the printer cover 3 is pivotally supported at a rear end of the housing 8. The printer cover 3 can move (can rotate) relative to the housing 8 between the closed position (FIG. 2) and the open position (FIG. 3) about the rotary axis RS1.

At the closed position, the printer cover 3 closes the housing 8 (for example, the interior of the housing 8 cannot be seen from the outside of the printer 1).

At the open position, the printer cover 3 opens the housing 8 (for example, the interior of the housing 8 can be seen from the outside of the printer 1).

When the printer cover 3 is at the closed position, the platen roller 10 and the thermal head 12 are opposed.

When the printer cover 3 rotates from the closed position to the open position, the front end of the printer cover 3 rotates away from the front end of the front panel 2 and of the housing 8.

When the printer cover 3 rotates from the open position to the closed position, the front end of the printer cover 3 rotates close to the front end of the front panel 2 and of the housing 8.

When the printer cover 3 is at the open position, the thermal head 12 is away from the platen roller 10.

The printer cover 3 has a front face. The front face is directed upward (UP) when the printer cover 3 is at the closed position. The front face is directed rearward (RR) when the printer cover 3 is at the open position.

The printer cover 3 has a rear face. The rear face is directed downward (LO) when the printer cover 3 is at the closed position. The rear face is directed forward (FR) when the printer cover 3 is at the open position.

In the housing 8, the front panel 2, the container 6, the first assisting roller 13, the platen roller 10 and the separator 15 are disposed.

The container 6 is located closer to the rear end of the housing 8.

The container 6 contains a roll of paper R.

As shown in FIG. 3, when the printer cover 3 is at the open position, the container 6 is accessible from the outside of the printer 1. Then a user can set the roll of paper R into the container 6.

The platen roller 10 is located forward (FR) of the first assisting roller 13. The platen roller 10 is rotatably supported at the housing 8.

The platen roller 10 is connected to a stepping motor (not illustrated). The platen roller 10 rotates under the control of the stepping motor so as to feed the print medium P.

The first assisting roller 13 is located forward (FR) of the container 6. The first assisting roller 13 is rotatably supported at the housing 8.

The separator 15 is located forward (FR) of the platen roller 10.

The separator 15 is a member having at least one plane (e.g., a separation plate) or a member having at least one curved surface (e.g., a separation pin).

When the platen roller 10 feeds a print medium P forward (FR), the separator 15 folds back the liner PM of the print medium downward (LO) and rearward (RR) so as to separate the printed label PL from the liner PM.

As shown in FIG. 2, a label ejection port 2*a* is defined between the printer cover 3 at the closed position and the housing 8 (i.e., an upper (UP) part of the front panel 2).

At a lower (LO) part of the front panel 2, a liner ejection port 2*b* is defined.

The label ejection port 2*a* is located forward (FR) of the separator 15.

The label ejection port 2*a* is to eject a label PL separated from the liner PM.

The liner ejection port 2*b* is located below (LO) the label ejection port 2*a*.

The liner ejection port 2*b* is to eject the liner PM after a label PL is separated from the liner PM.

As shown in FIG. 2, when the touch panel display 3 is at the closed position, the touch panel display 4 is located at the top face of the printer cover 3.

The touch panel display 4 displays predetermined information. The predetermined information contains information on the printer 1 and images of operation keys. When a user touches an image of operation key, the processor of the printer 1 receives an instruction corresponding to the touched operation key.

The touch panel display 4 is a liquid crystal display having a touch sensor, for example.

As shown in FIGS. 3 to 5, the printer cover 3 includes the thermal head 12, the second assisting roller 14, a head bracket 20, the head cover 21, a connector unit 22 (one example of a connecting part) and a pair of gears 23. When the printer cover 3 is at the closed position, the thermal head 12, the second assisting roller 14, the head bracket 20, the head cover 21, the connector unit 22, and the pair of gears 23 are located on the lower face of the printer cover 3.

As shown in FIGS. 3 and 4, the head cover 21 is pivotally supported at the printer cover 3. The head cover 21 can move (i.e., can rotate) relative to the printer cover 3 between a closed position (one example of a first position) of FIG. 3 and an open position (one example of a second position) of FIG. 4 about the rotary axis RS2. The rotary axis RS2 is parallel to the rotary axis RS1.

The head cover 21 at the closed position closes a part of the thermal head 12. In this case, a part of the thermal head 12 and the connector unit 22 (FIG. 4) are covered by the head cover 21, and therefore they cannot be seen from the outside of the printer 1.

The head cover 21 at the open position opens the connector unit 22. Specifically a space is defined between the head cover 21 at the open position and the printer cover 3. The connector unit 22 is exposed through this space. The connector unit 22 has a connector 22*a* (described later) as a connecting terminal, and the connector 22*a* is directed upward (UP). In this case, the thermal head 12 and the connector unit 22 can be seen from the outside of the printer 1.

The second assisting roller 14 is rotatably supported at the printer cover 3.

The second assisting roller 14 assists the feeding of the print medium P while rotating following the rotation of the first assisting roller 13.

As shown in FIG. 5, the head bracket 20 includes a pair of convexes 20*a*, a pair of protrusions 20*b* and a head bracket body 20*d*.

The pair of convexes 20*a* protrudes forward (FR) from the head bracket body 20*d*.

The head cover 21 includes a pair of engaging parts 21*a* and a pair of gears 21*b*.

The pair of engaging parts 21*a* is located at lateral ends of the head cover 21.

The pair of engaging parts 21*a* engages with the pair of protrusions 20*b* so as to lock the head cover 21 at the closed position (FIG. 3).

When a user rotates the head cover 21, the engagement between the pair of engaging parts 21*a* and the pair of protrusions 20*b* is canceled.

Figure 6A:
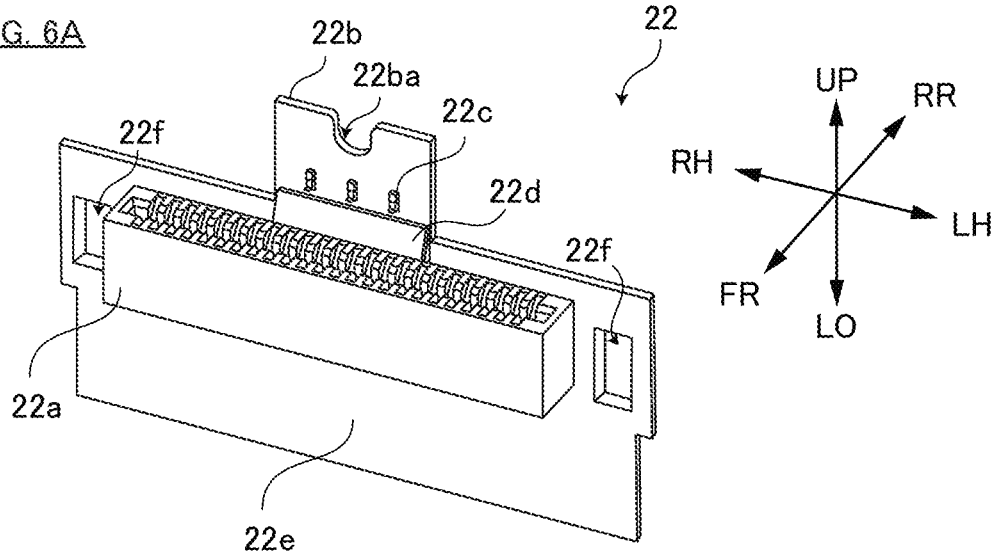
FIG. 6 shows a major part of a connector unit of FIG. 5.
Figure 6B:
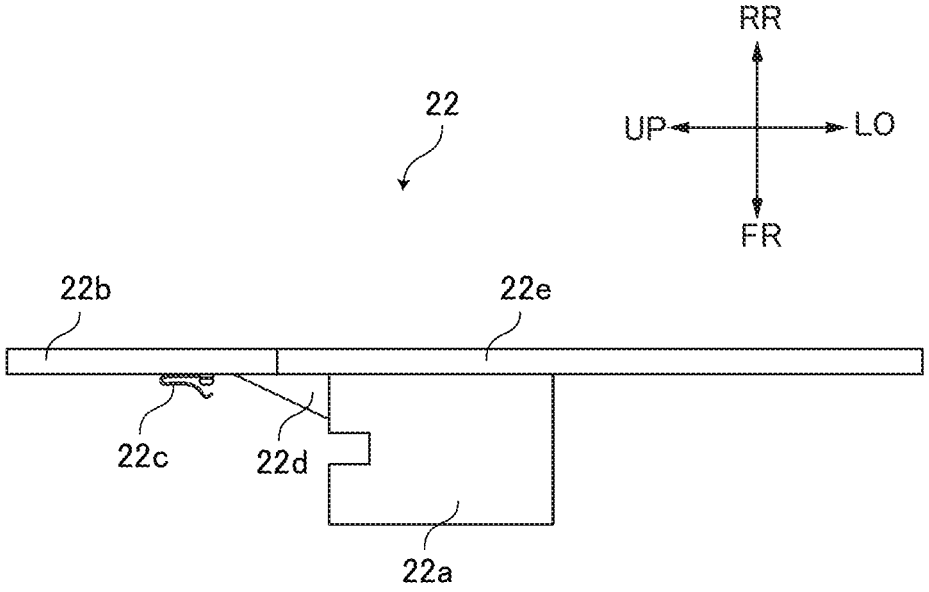

As shown in FIGS. 6A and 6B, the connector unit 22 has a front face. On the front face, the connector 22*a* (one example of a second connector), an abutting part 22*b*, a plurality of metal members 22*c*, a guide 22*d*, a connector board 22*e*, and a pair of engagement holes 22*f* are disposed.

The connector 22*a* is disposed on the front face of the connector board 22*e*.

The abutting part 22*b* protrudes upward (UP) from the upper end of the connector board 22*e*. The abutting part 22*b* has a notch 22*ba*. The notch 22*ba* is at a center of the connector unit 22 in the width direction (LH-RH direction).

The plurality of metal members 22*c* is disposed on the front face of the abutting part 22*b*.

Each of the metal members 22*c* is connected to the earth cable (not illustrated).

Each of the metal members 22*c* is a metal spring, for example.

The guide 22*d* is located above (UP) the connector 22*a*. The guide 22*d* is at a center of the connector unit 22 in the width direction (LH-RH direction).

The front face of the guide 22*d* inclines so that the lower end is located forward (FR) of the upper end (i.e., coming closer to the connector 22*a* from the above (UP) to the below (LO) in the front-rear direction (FR-RR direction)).

As shown in FIG. 5, the pair of gears 23 engages with the pair of engagement holes 22*f* and the pair of gears 21*b*. Such engagement converts the rotary motion of the head cover 21 into the motion of the connector unit 22 in the up-down direction (UP-LO direction) via the pair of gears 23.

That is, a gear mechanism is made up of the pair of gears 21*b* and the pair of gears 23, and this gear mechanism is a moving mechanism to join with the connector unit 22 and with the head cover 21. As the head cover 21 is moved, this moving mechanism moves the connector unit 22 (e.g., slides it in the up-down direction (UP-LO direction)) for connection and disconnection of the thermal head 12 and the connector unit 22.

The thermal head 12 can be connected to and disconnected from the connector unit 22.

Figure 7A:
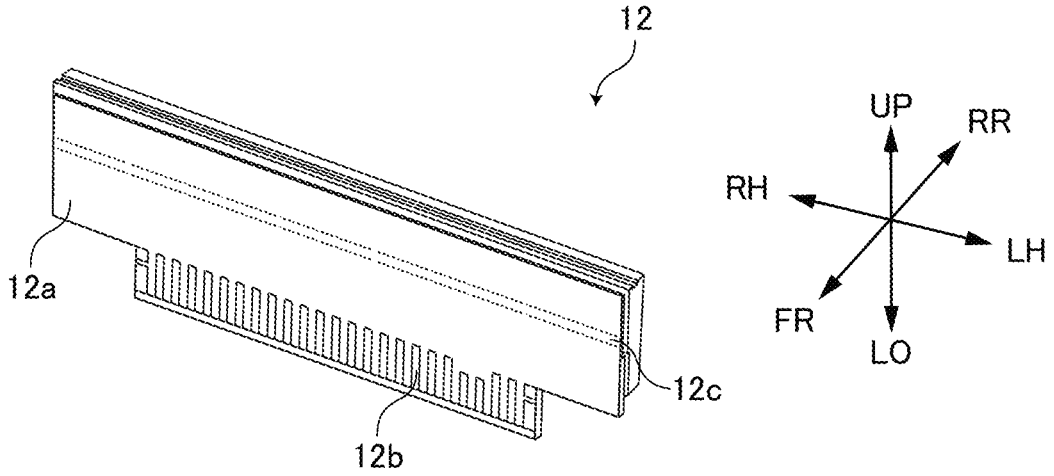
FIG. 7 is a perspective view of a major part of a thermal head of FIG. 5.
Figure 8:
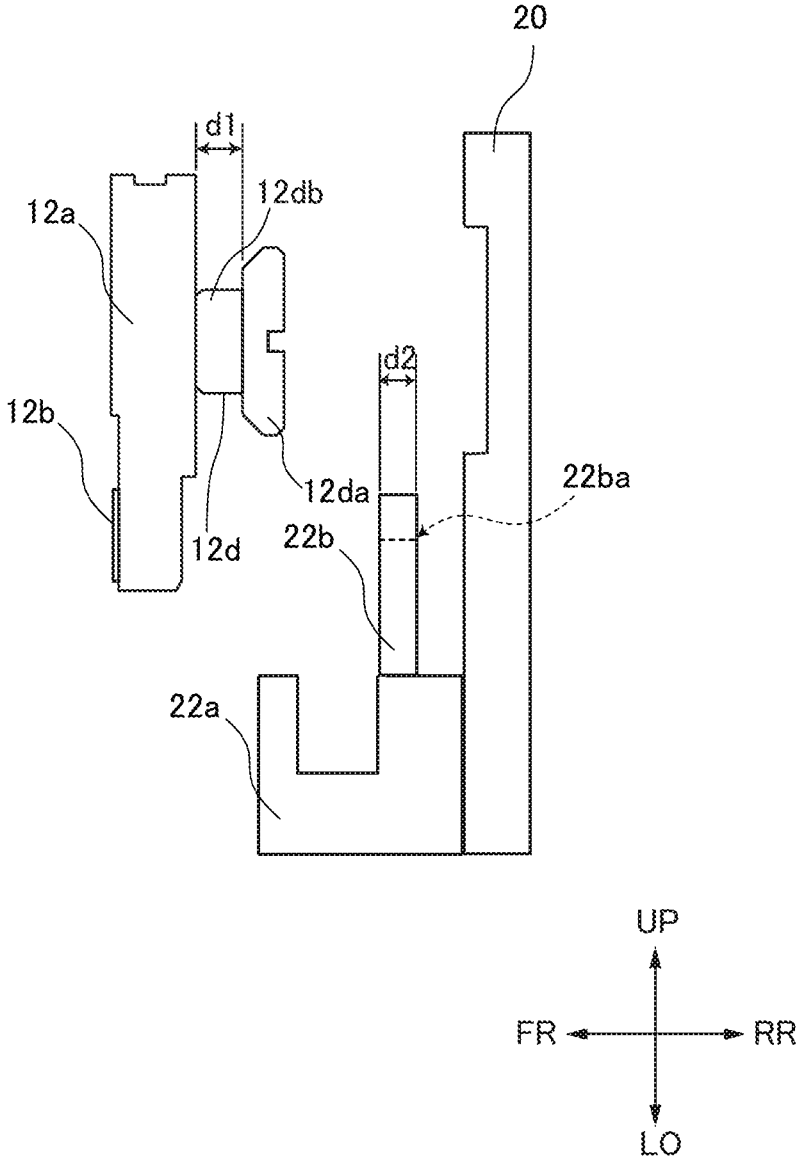
FIG. 8 is a side view of the major parts of the head bracket of FIG. 5, the connector unit of FIG. 6, and the thermal head of FIG. 7.

As shown in FIG. 7A, the thermal head 12 has a front face. On the front face, a thermal head body 12*a*, a connector 12*b* (one example of a first connector), and a plurality of heater elements 12*c* are disposed.

Figure 7B:
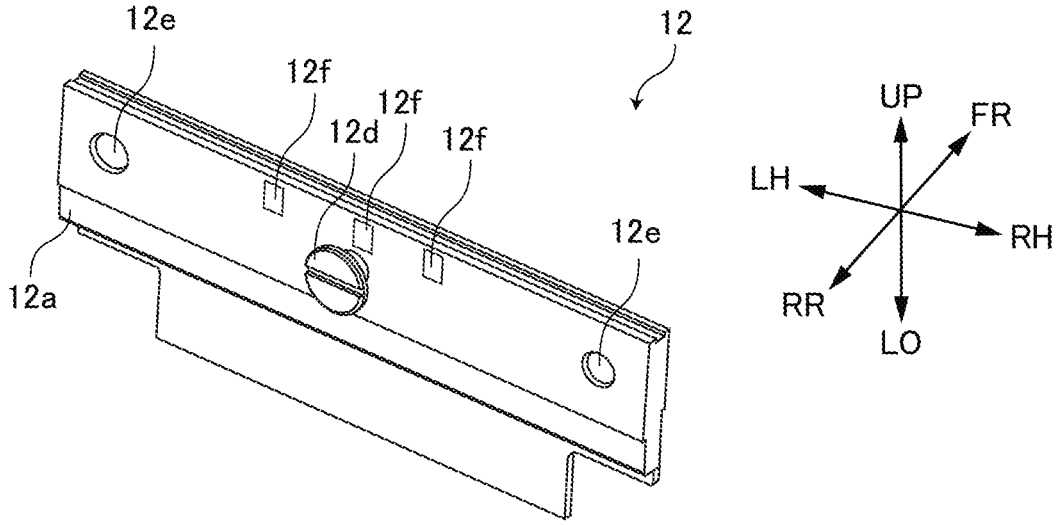

As shown in FIG. 7B, the thermal head 12 has a rear face. On the rear face, a connector unit limiter 12*d* (one example of a connection position limiter), a pair of concaves 12*e* and a plurality of earth parts 12*f* are disposed.

The connector 12*b* protrudes downward (LO) from the thermal head body 12*a*. The connector 12*b* is at a center of the thermal head 12 in the width direction (LH-RH direction).

The plurality of heater elements 12*c* is located above (UP) the connector 12*b*. The plurality of heater elements 12*c* is aligned along the width direction (LH-RH direction) of the thermal head 12. This aligning direction of the plurality of heater elements 12*c* is called a "print line direction".

The pair of concaves 12*e* is located on opposite sides of the connector unit limiter 12*d* in the width direction (LH-RH direction).

The connector unit limiter 12*d* protrudes rearward (RR) from the rear face of the thermal head body 12*a*.

As shown in FIG. 8, the connector unit limiter 12*d* includes a first limiter 12*da* and a second limiter 12*db*.

The second limiter 12*db* protrudes rearward (RR) from the rear face of the thermal head body 12*a*.

The second limiter 12*db* joins with the thermal head body 12*a* and with the first limiter 12*da*.

The size d1 of the second limiter 12*db* is substantially the same as the size d2 of the notch 22*ba* in the front-rear direction (FR-RR direction).

As shown in FIG. 7, each of the earth parts 12*f* is located above (UP) the connector unit limiter 12*d* in the up-down direction (UP-LO direction).

The connector unit 22 can be connected to and disconnected from the thermal head 12. Connecting of the connector unit 22 to the thermal head 12 establishes a connection of the thermal head 12 to a control circuit (not illustrated).

(3) Feed Path

Figure 9:
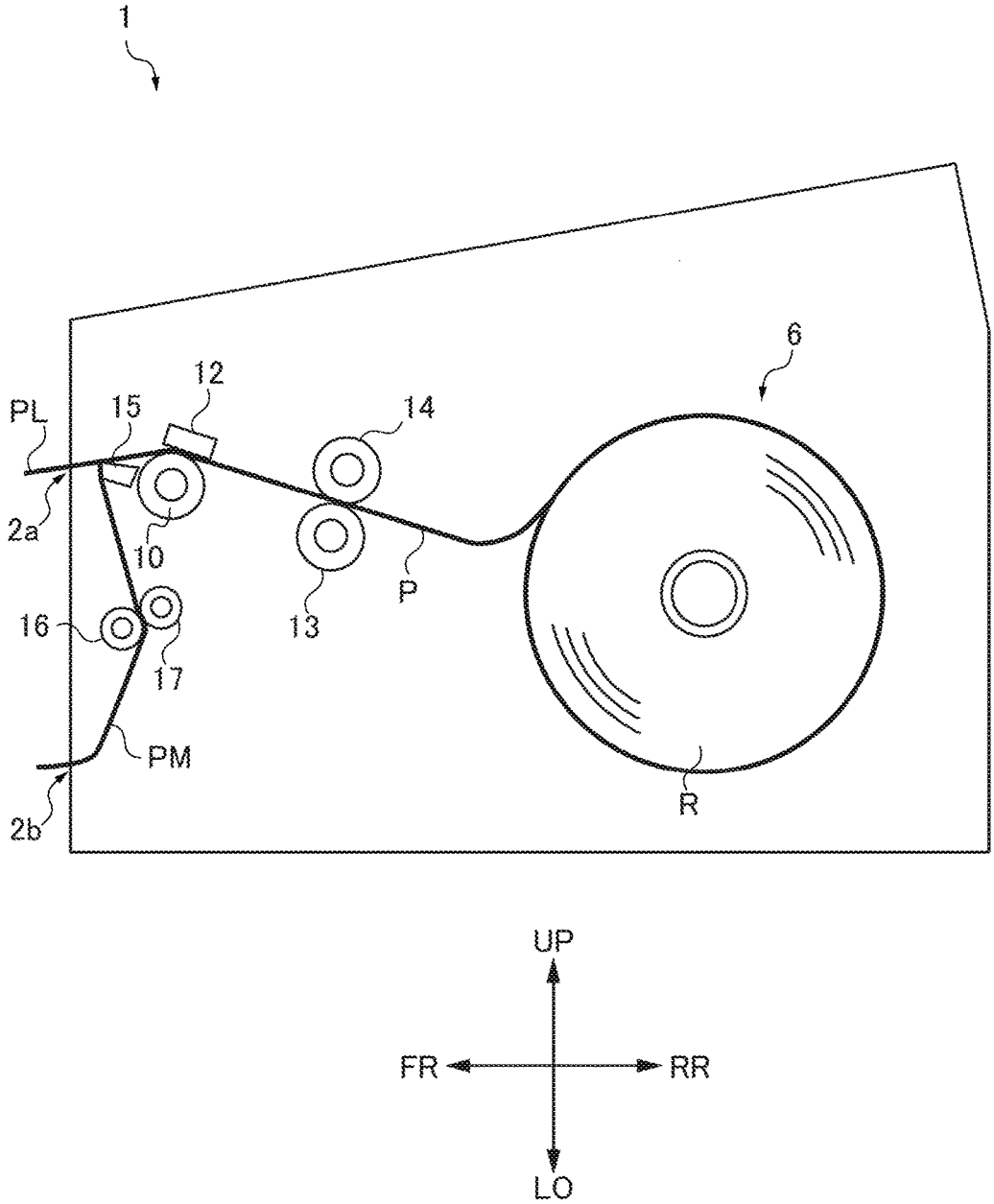
FIG. 9 schematically shows the feed path of the present embodiment.

The following describes a feed path of the present embodiment. FIG. 9 schematically shows the feed path of the present embodiment.

As shown in FIG. 9, the feed path of the print medium P is a path between the container 6 and the separator 15. The feed path of the print medium P extends through the first assisting roller 13, the second assisting roller 14, the thermal head 12 and the platen roller 10.

The feed path of the labels PL is a path between the separator 15 and the label ejection port 2*a*.

The feed path of the liner PM is a path between the separator 15 and the liner ejection port 2*b*. The feed path of the liner PM extends through a first nip roller 16 and a second nip roller 17.

The container 6 contains a roll of paper R.

The first assisting roller 13 and the second assisting roller 14 are located downstream of the container 6 in the feeding direction. The first assisting roller 13 is located under (LO) the feed path. The second assisting roller 14 is located below (UP) the feed path. That is, when the printer cover 3 is at the closed position (FIG. 2), the first assisting roller 13 and the second assisting roller 14 are opposed.

The first assisting roller 13 is connected to a stepping motor. The first assisting roller 13 rotates under the control of the stepping motor.

The second assisting roller 14 rotates following the rotation of the first assisting roller 13.

The first assisting roller 13 and the second assisting roller 14 rotate while keeping the print medium P therebetween so as to assist the feeding of the print medium P.

The platen roller 10 and the thermal head 12 are located downstream of the first assisting roller 13 and the second assisting roller 14 in the feeding direction. The platen roller 10 is located below (LO) the feed path.

The thermal head 12 is located above (UP) the feed path. That is, when the printer cover 3 is at the closed position (FIG. 2), the platen roller 10 and the thermal head 12 are opposed.

The separator 15 is located downstream of the platen roller 10 and the thermal head 12 in the feeding direction.

The upper face and the front face of the separator 15 define a sharp angle.

The first nip roller 16 and the second nip roller 17 are located downstream of the separator 15 in the feeding direction. The first nip roller 16 and the second nip roller 17 are opposed.

The first nip roller 16 rotates following the rotation of the second nip roller 17.

The second nip roller 17 is connected to a stepping motor. The second nip roller 17 rotates under the control of the stepping motor.

The first nip roller 16 and the second nip roller 17 rotate while keeping the liner PM therebetween so as to feed the liner PM from the separator 15 to the liner ejection port 2*b*.

As the platen roller 10 rotates forward (counterclockwise in FIG. 9), a belt-like print medium P (the combination of labels PL and liners PM) is extracted from the container 6 to the downstream of the container 6 in the feeding direction. The lower face of the extracted print medium P is the non temporary-adhesive face PMb of the liner PM. The upper face of the extracted print medium P is the print surface PLa.

As the platen roller 10 rotates forward, the first assisting roller 13 rotates counterclockwise in FIG. 9 while having a contact with the non temporary-adhesive face PMb. At the same time, the second assisting roller 14 rotates clockwise in FIG. 9 while having a contact with the print surface PLa.

The control circuit receives print data corresponding to information to be printed on the print surface PLa (hereinafter called "print information") in response to a user's instruction. The control circuit controls the heater elements to generate heat in accordance with the print data.

When the print medium P passes through between the thermal head 12 and the platen roller 10, the heater elements generating heat are pressed against the print surface PLa. Due to the heat of the heater elements, the thermosensitive layer at the print surface PLa develops a color. As a result, print information is printed on the print surface PLa.

The label PL is fed from the front end of the separator 15 to the label ejection port 2*a*.

The liner PM along the front face of the separator 15 is folded back downward (LO) and rearward (RR), and then is fed toward the liner ejection port 2*b*.

In other words, the separator 15 folds back the liner PM at a sharp angle relative to the label PL. As a result, the separator 15 separates the label PL from the liner PM.

The label PL separated from the liner PM is ejected from the label ejection port 2*a*.

The liner PM after the label PL is separated (i.e., the liner PM passing through the front end of the separator 15) passes through between the first nip roller 16 and the second nip roller 17, and then is ejected from the liner ejection port 2*b*.

(4) Connecting and Disconnecting of Thermal Head and Connector Unit

The following describes connecting and disconnecting of the thermal head and the connector unit of the present embodiment.

(4-1) Connecting of Thermal Head to Connector Unit

Figure 10A:
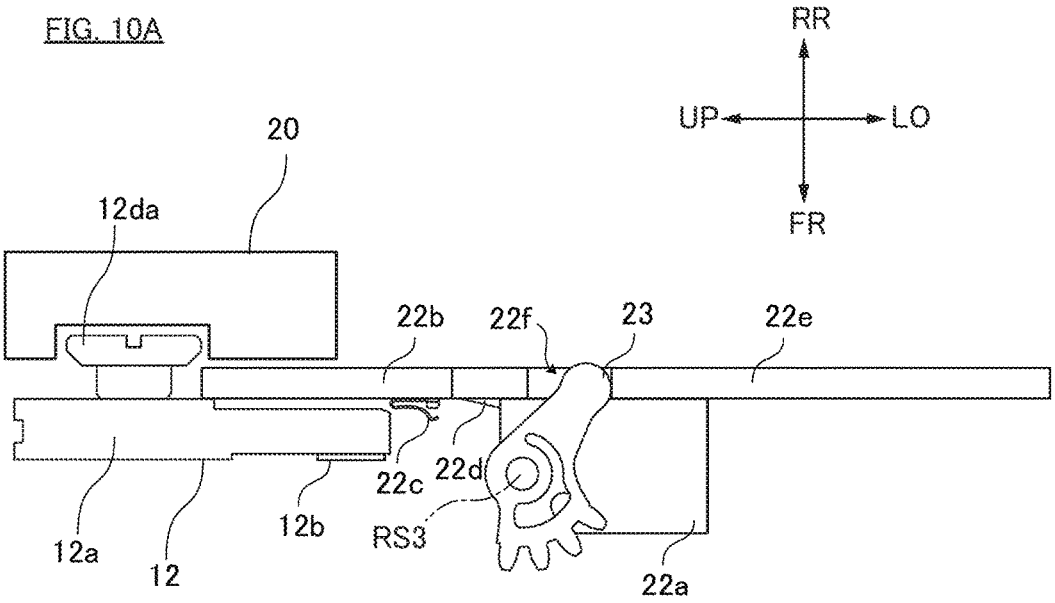
FIG. 10 is a cross-sectional view showing the thermal head of the present embodiment before connecting to the connector unit.
Figure 10B:
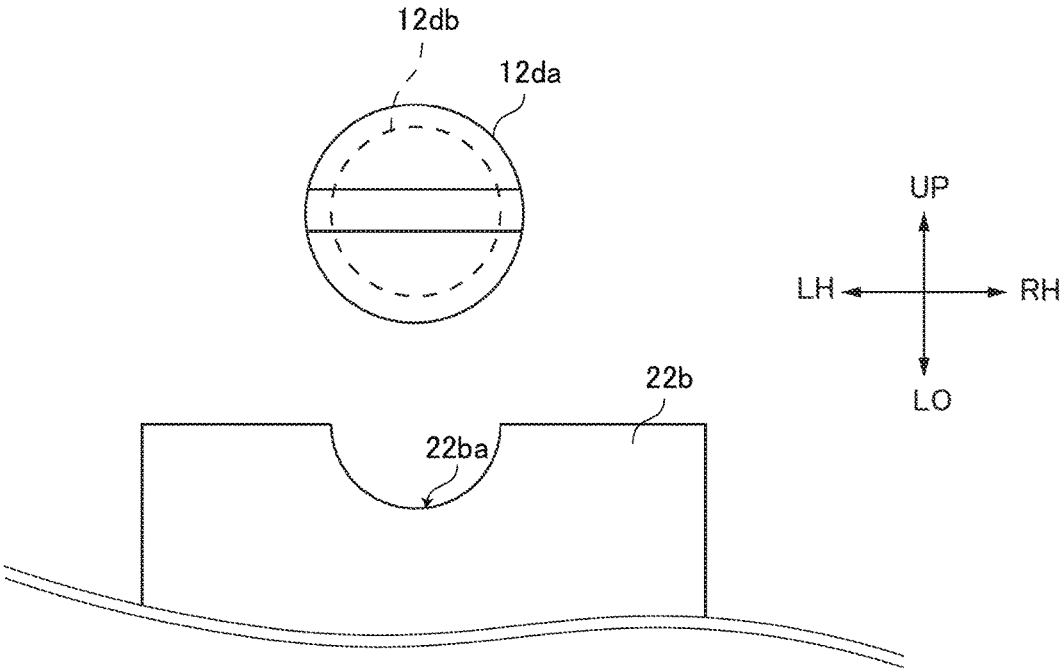
Figure 11:
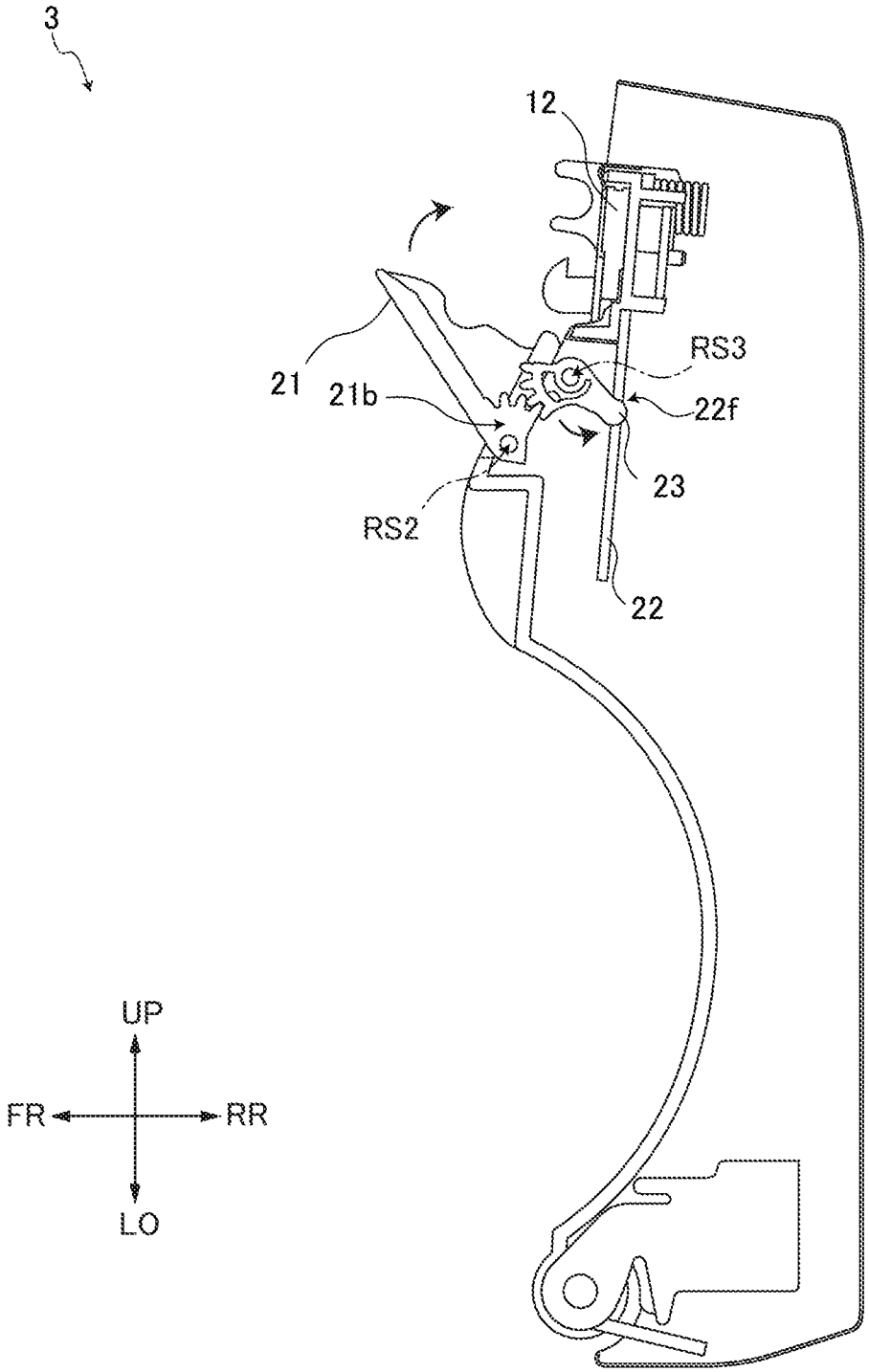
FIG. 11 is a side view of a major part of the opening and closing cover corresponding to FIG. 10.

The following describes connecting of the thermal head to the connector unit of the present embodiment. FIG. 10 is a cross-sectional view showing the thermal head of the present embodiment before connecting to the connector unit. FIG. 11 is a side view of a major part of the opening and closing cover corresponding to FIG. 10. FIG. 12 is a cross-sectional view of the head cover of the present embodiment when the head cover moves from the open position of FIG. 11 to the closed position of FIG. 13. FIG. 13 is a side view of a major part of the opening and closing cover when the head cover of the present embodiment is at a closed position. FIG. 14 is a cross-sectional view showing the thermal head of the present embodiment when connecting to the connector unit.

Before connecting the thermal head 12 to the connector unit 22, a user sets the head cover 21 at the open position (FIG. 4).

Next, as shown in FIG. 5, the user attaches the thermal head 12 to the head bracket 20. Specifically the user fits the pair of concaves 12*e* with the pair of convexes 20*a*. This holds the thermal head 12. That is, the pair of concaves 12*e* and the pair of convexes 20*a* function as a holding part to hold the thermal head 12. In other words, the printer cover 3 is configured to hold the thermal head 12 via the head bracket 20.

At this time, the guide 22*d* limits the position of the lower end of the thermal head 12 in the front-rear direction (FR-RR direction). This can prevent the connector unit 22 from catching the lower end of the thermal head 12 when the user attaches the thermal head 12 to the head bracket 20 for holding.

Instead of the concaves 12*e* and the convexes 20*a*, convexes at the thermal head 12 and concaves at the head bracket 20 may hold the thermal head 12.

The abutting part 22*b* extends parallel to the connector 12*b* of the held thermal head 12.

As shown in FIG. 11, when the user rotates the head cover 21 clockwise (i.e., in the opposite direction of the rotating direction of the printer cover 3 when it rotates from the open position to the closed position) around the rotary axis RS2, the gears 23 rotate counterclockwise around the rotary axis RS3 with the rotation of the head cover 21.

Figure 12A:
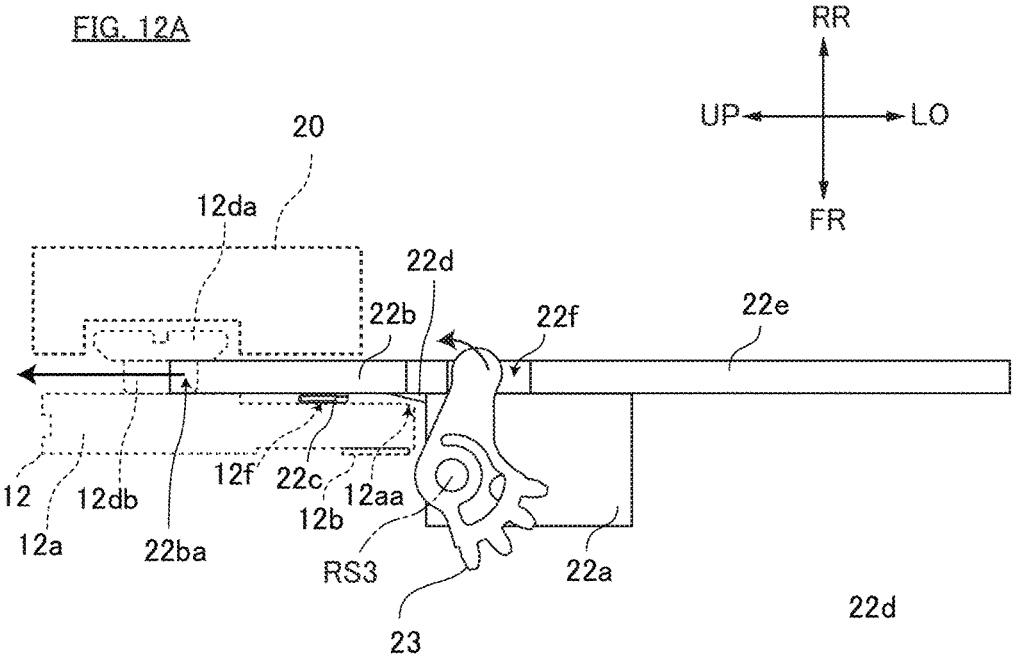
FIG. 12 is a cross-sectional view of the head cover of the present embodiment when the head cover moves from the open position of FIG. 11 to the closed position of FIG. 13.
Figure 13:
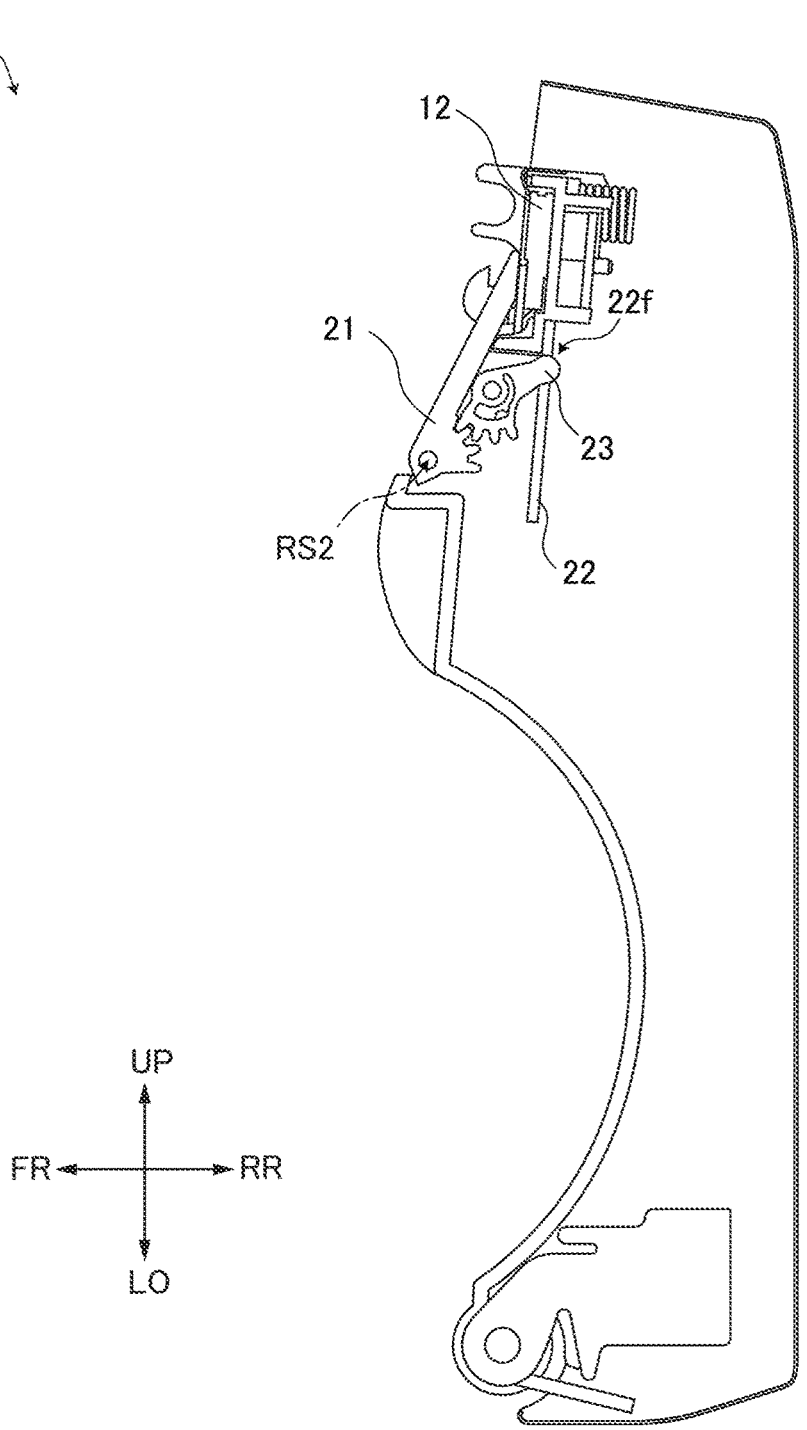
FIG. 13 is a side view of a major part of the opening and closing cover when the head cover of the present embodiment is at a closed position.

As shown in FIG. 12A, each gear 23 rotates counterclockwise while having a contact with the upper end of the engagement hole 22*f*.

Figure 12B:
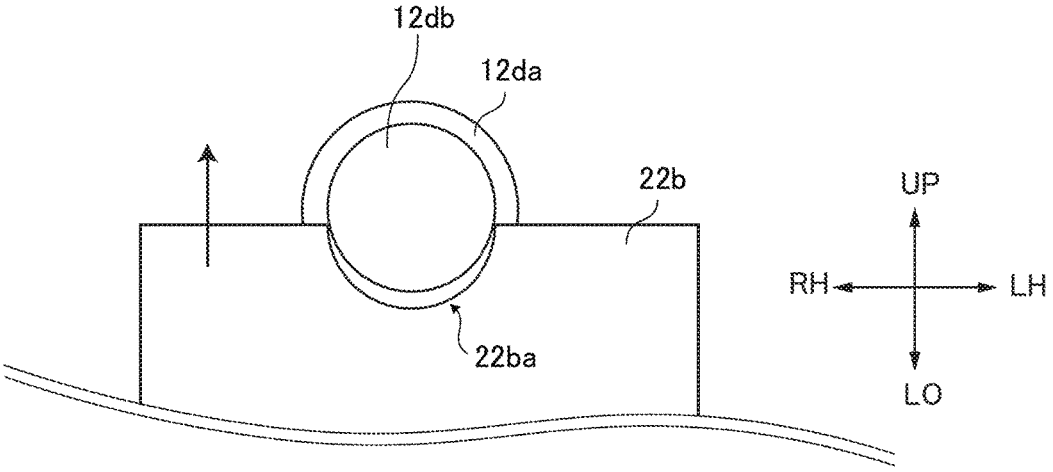

As shown in FIG. 12B, as the gears 23 rotate, the connector unit 22 moves upward (UP) (i.e., in the direction toward the thermal head 12 held by the head bracket 20).

As shown in FIG. 12B, as the gears 23 rotate, the abutting part 22*b* moves upward (UP).

At this time, the abutting part 22*b* contacts with the outer periphery of the second limiter 12*db*. Specifically the connector unit 22 moves while having its notch 22*ba* engaging with the connector unit limiter 12*d*. This can limit the position of the connector unit 22 in the up-down direction (UP-LO direction) during connection and disconnection of the connector unit 22 and the thermal head 12.

As shown in FIG. 8, the size d1 of the second limiter 12*db* is substantially the same as the size d2 of the notch 22*ba* in the front-rear direction (FR-RR direction).

When the notch 22*ba* engages with the second limiter 12*db*, the front face of the notch 22*ba* contacts with the rear face of the thermal head body 12*a* and the rear face of the notch 22*ba* contacts with the front face of the first limiter 12*da*. This enables the positioning of the connector unit 22 in the front-rear direction (FR-RR direction).

That is, the first limiter 12*da* limits the position of the connector unit 22 in the front-rear direction (FR-RR direction).

The notch 22*ba* engaging with the second limiter 12*db* supports the lower face and the outer periphery of the second limiter 12*db*. This enables the positioning of the connector unit 22 in the up-down direction (UP-LO direction) and in the width direction (LH-RH direction). That is, the second limiter 12*db* limits the position of the connector unit 22 in the moving direction (UP-LO direction) and in the width direction (LH-RH direction).

In this way, the engagement of the notch 22*ba* with the second limiter 12*db* enables the positioning of the connector unit 22. As a result, the connector unit 22 can move in parallel with the thermal head 12.

That is, the second limiter 12*db* and the abutting part 22*b* limit the position of the thermal head 12 in the moving direction (UP-LO direction) of the connector unit 22 and in the directions (FR-RR direction and LH-RH direction) orthogonal to the moving direction (UP-LO direction) of the connector unit 22.

The head bracket 20 has a front face. This front face has a concave to which the first limiter 12*da* retracts.

The second limiter 12*db* and the abutting part 22*b* may limit the position of the thermal head 12 in the moving direction (UP-LO direction) of the connector unit 22 only. In this case, the position of the thermal head 12 is not limited in the directions (FR-RR direction and LH-RH direction) orthogonal to the moving direction (UP-LO direction) of the connector unit 22. That is, the thermal head 12 and the connector unit 22 have a clearance therebetween in the directions (FR-RR direction and LH-RH direction) orthogonal to the moving direction (UP-LO direction) of the connector unit 22.

As shown in FIG. 12A, the metal members 22*c* come in contact with the earth parts 12*f*. This allows electrical charge stored in the thermal head 12 to be released to the outside of the thermal head 12 through the earth cable. That is, the metal members 22*c* remove static electrical charge of the thermal head 12.

Figure 14A:
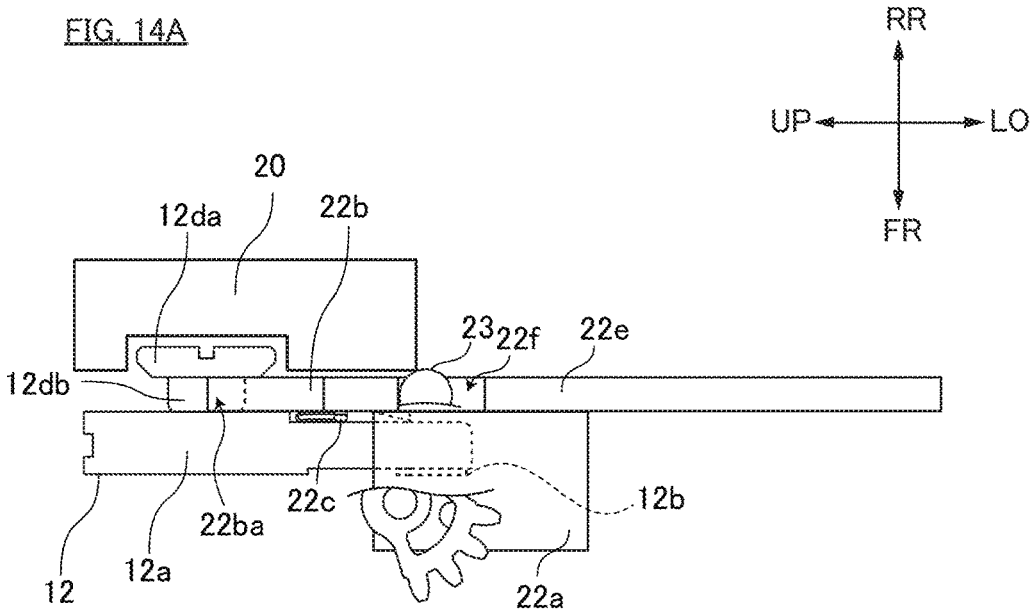
FIG. 14 is a cross-sectional view showing the thermal head of the present embodiment when connecting to the connector unit.

As shown in FIG. 13, when the head cover 21 reaches the closed position, the connector 12*b* connects to the connector 22*a* as shown in FIG. 14A.

The pair of engaging parts 21*a* of FIG. 5 engages with the pair of protrusions 20*b*. This engagement functions as a locking part to lock the head cover 21 at the closed position. This locks the connection of the thermal head 12 to the connector unit 22 as well.

Figure 14B:
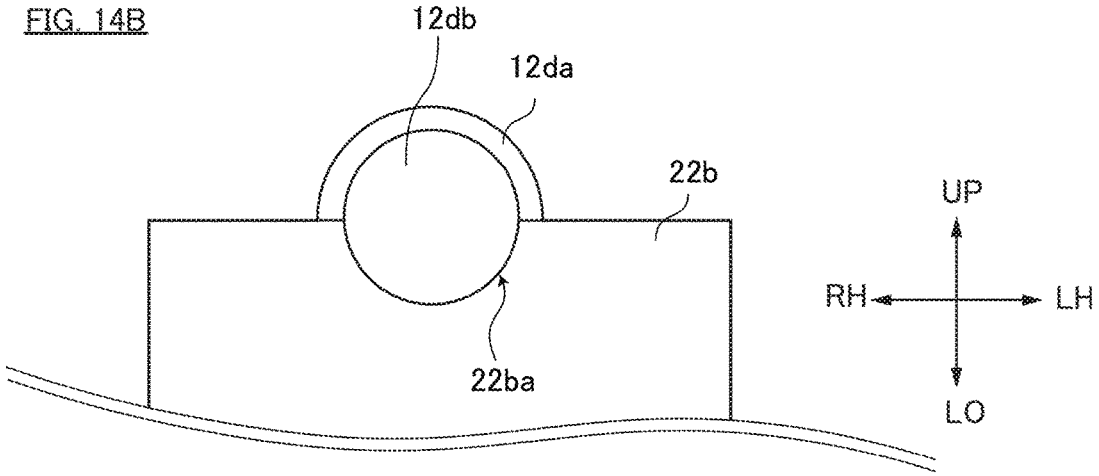

As shown in FIG. 14B, the notch 22*ba* engages with a part of the second limiter 12*db*. This can fix the position of the connector unit 22 connected to the thermal head 12.

(4-2) Disconnecting of Thermal Head from Connector Unit

The following describes disconnecting of the thermal head from the connector unit of the present embodiment. FIG. 15 shows the head cover of the present embodiment when the head cover moves from the closed position of FIG. 13 to the open position of FIG. 11.

In order to disconnect the thermal head 12 from the connector unit 22, the user rotates the head cover 21 counterclockwise in FIG. 13 (i.e., in the opposite direction of the rotating direction of the printer cover 3 when it rotates from the closed position to the open position) around the rotary axis RS2. Then the head cover 21 moves from the closed position (FIG. 13) to the open position (FIG. 11) with the rotation.

Figure 15A:
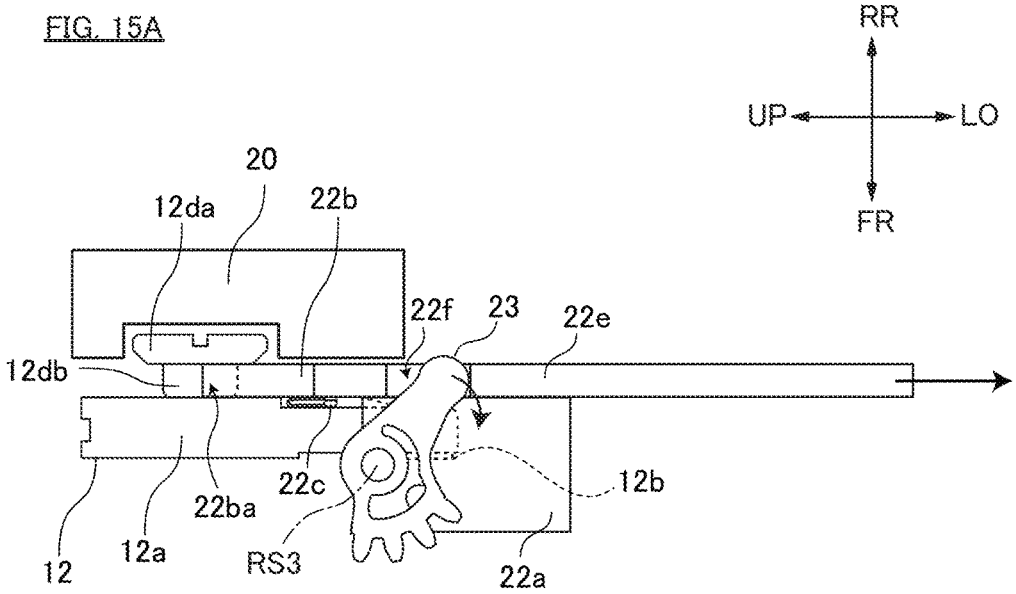
FIG. 15 shows the head cover of the present embodiment when the head cover moves from the closed position of FIG. 13 to the open position of FIG. 11.

As shown in FIG. 15A, each gear 23 rotates clockwise while having a contact with the lower end of the engagement hole 22*f*.

Figure 15B:
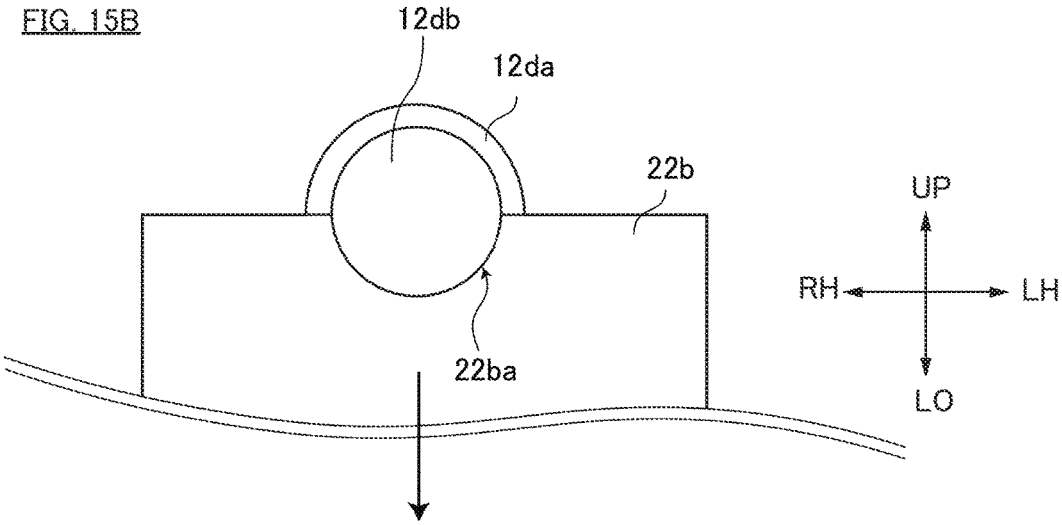

As shown in FIG. 15B, as the gears 23 rotate, the connector unit 22 moves downward (LO) (i.e., in the direction away from the thermal head 12 held by the head bracket 20). This disconnects the thermal head 12 from the connector unit 22.

(5) Summary of Embodiment

The following describes summary of the present embodiment.

As described above, when the user moves the head cover 21 of the present embodiment, connecting or disconnecting of the connector 12*b* as the connecting terminal of the thermal head 12 and the connector 22*a* as the connecting terminal of the printer body occurs. That is, the user can connect or disconnect the thermal head 12 and the connector unit 22 without touching the thermal head 12 and the connector unit 22. This facilitates the connecting and disconnecting of the thermal head 12 and the connector unit 22.

When a user touches the thermal head 12, dirt may adhere to the thermal head 12. Such dirt may cause malfunction of the thermal head 12. According to the present embodiment, after attaching the thermal head 12 to the head bracket 20 for holding, a user need not touch the thermal head 12. This can suppress adherence of dirt to the thermal head 12.

According to the present embodiment, the first limiter 12*da* limits the position of the connector unit 22 when the thermal head 12 connects to the connector unit 22. This enables reliable connection of the thermal head 12 to the connector unit 22.

In the present embodiment, the pair of concaves 12*e* and the pair of convexes 20*a* hold the thermal head 12 before moving the connector unit 22. This enables reliable connection of the thermal head 12 to the connector unit 22 during connection and disconnection of the thermal head 12 and the connector unit 22.

In the present embodiment, the pair of concaves 12*e* and the pair of convexes 20*a* hold the thermal head 12 when the user attaches the thermal head 12 to the connector unit 22.

This makes the attachment of the thermal head 12 to the connector unit 22 easier.

In the present embodiment, the gear mechanism moves the connector unit 22.

This can minimize the rotary motion of the head cover 21 required for connection or disconnection of the thermal head 12 and the connector unit 22. This can reduce burden on user's operation required for connection or disconnection of the thermal head 12 and the connector unit 22.

This can minimize a space required to move the head cover 21 as well. This enables easy replacement of the thermal head 12 without increasing the printer 1 in size.

In the present embodiment, engagement of the pair of engaging parts 21*a* with the pair of protrusions 20*b* locks the head cover 21 at the closed position (FIG. 3). This can prevent unexpected cancellation of the connection of the thermal head 12 to the connector unit 22.

In the present embodiment, before the thermal head 12 is connected to the connector unit 22, the metal members 22*c* come in contact with the earth parts 12*f*. This can remove statistic electrical charge of the thermal head 12. This can prevent damage of the thermal head 12 by electrostatic discharge.

In the present embodiment, the head cover 21 at the open position and the printer cover 3 define a space therebetween. Since the connector unit 22 is exposed through this space, the user can recognize the connector unit from the outside of the printer 1.

This allows a user to move the head cover 21 to the open position (FIG. 4) and then attach the thermal head 12 to the head bracket 20 easily. This facilitates for the user attachment or detachment the thermal head 12 and the connector unit 22.

In the present embodiment, the connector unit 22 moves in parallel with the thermal head 12. This allows the user to connect or disconnect the thermal head 12 and the connector unit 22 easily without breaking the thermal head 12 and the connector unit 22.

(6) Modified Examples

The following describes modified examples of the present embodiment.

(6-1) Modified Example 1

The following describes Modified Example 1. Modified Example 1 describes an additional function of the guide 22*d*.

As shown in FIG. 12A, as the connector unit 22 moves upward (UP), the lower end 12*aa* of the rear face of the thermal head body 12*a* may slide along the guide 22*d*. This guides the thermal head 12 forward (FR) (i.e., the direction toward the connector 22*a*).

That is, the guide 22*d* limits the position of the thermal head 12 in the front-rear direction (FR-RR).

(6-2) Modified Example 2

The following describes Modified Example 2. Modified Example 2 describes a preferable example of the head cover 21 in size.

A longer distance between the rotary axis RS2 of the head cover 21 of FIG. 5 and the upper end of the head cover 21 of the FIG. 3 is preferred. Such a longer distance means a smaller force required to rotate the head cover 21.

That is, such a longer distance can reduce the burden on user's operation to connect or disconnect the thermal head 12 and the connector unit 22.

(6-3) Modified Example 3

The following describes Modified Example 3. Modified Example 3 describes a preferable example of a ratio of the number of gear teeth of the pair of gears 21*b* to the pair of gears 23 (hereinafter called a "gear ratio").

A larger gear ratio of the pair of gears 21*b* to the pair of gears 23 is preferred.

Such a larger gear ratio means a smaller amount of rotation of the head cover 21 required for connection or disconnection of the thermal head 12 and the connector unit 22. Such a larger gear ratio means a smaller force required to rotate the head cover 21.

That is, a larger gear ratio can reduce the burden on user's operation to connect or disconnect the thermal head 12 and the connector unit 22.

(6-4) Modified Example 4

The following describes Modified Example 4. In Modified Example 4, the connector unit 22 moves in response to the operation performed to an operation member different from the head cover 21.

In one example, the printer cover 3 (FIG. 3) has a lever (one example of the operation member).

The lever has a pair of gears. The pair of gears of the lever engages with the pair of gears 23 (FIG. 5). Such engagement converts the rotary motion of the lever into the motion of the connector unit 22 in the up-down direction (UP-LO direction) via the pair of gears 23.

That is, a gear mechanism is made up of the pair of gears of the lever and the pair of to gears 23, and this gear mechanism is a moving mechanism to join with the connector unit 22. This moving mechanism moves the connector unit 22 in response to the rotating operation of the lever.

In Modified Example 4, the head cover 21 (FIG. 3) can be omitted.

(6-5) Modified Example 5

The following describes Modified Example 5. In Modified Example 5, the connector unit 22 moves with a motion different from the rotating motion.

In one example, the following describes a head cover 21 in FIG. 5 that is slidable in the up-down direction (UP-LO direction) relative to the printer cover 3.

In FIG. 5, the head bracket 20 has a guide groove at each end in the width direction (LH-RH direction), and the guide grooves extend in the up-down direction (UP-LO direction).

The head cover 21 has a joint part and an engagement part.

The join part joins the connector unit 22.

The engagement part is located at ends of the head cover 21 in the width direction (LH-RH direction). The engagement part engages with the guide grooves.

That is, the head cover 21 in Modified Example 5 joins the connector unit 22 and engages with the printer cover 3 slidably.

In order to connect the thermal head 12 to the connector unit 22, a user slides the head cover 21 downward (LO) until the head cover 21 is located at the lower end of the guide grooves (one example of the open position).

Next, the user slides the head cover 21 upward (UP) until the head cover 21 is located at the upper end of the guide grooves (one example of the closed position). This moves the connector unit 22 upward (UP) (in the direction toward the thermal head 12).

When the thermal head 12 is disconnected from the connector unit 22, the user slides the head cover 21 to the open position.

As the head cover 21 slides, the connector unit 22 moves downward (LO) (i.e., in the direction away from the thermal head 12).

This disconnects the thermal head 12 from the connector unit 22.

As described above, in Modified Example 5, the sliding operation of the head cover 21 results in connection or disconnection of the thermal head 12 and the connector unit 22.

In Modified Example 5, the operation member of Modified Example 4 may be used instead of the head cover 21.

In Modified Example 5, the pair of gears 21*b* and the pair of gears 23 can be omitted.

(6-6) Modified Example 6

The following describes Modified Example 6. In Modified Example 6, a user moves the thermal head 12 instead of the connector unit 22 to connect or disconnect the thermal head 12 and the connector unit 22.

In one example, a head bracket 20 of FIG. 5 has a pair of engagement holes. The head bracket 20 holds the thermal head 12.

The pair of gears 23 engages with the pair of engagement holes of the head bracket 20 and not with the pair of engagement holes 22*f*. That is, the head cover 21 joins with the thermal head 12 held by the head bracket 20 via the pair of gears 23.

When a user rotates the head cover 21 clockwise around the rotary axis RS2 of FIG. 11, the head bracket 20 moves downward (LO) (i.e., in the direction toward the connector unit 22) with the rotation of the gears 23 while holding the thermal head 12.

At this time, the abutting part 22*b* contacts with the outer periphery of the second limiter 12*db*. That is, the thermal head 12 moves while having the connector unit limiter 12*d* coming in contact with the connector unit 22.

As stated above, in Modified Example 6, the moving mechanism moves the head bracket 20 with the motion of the head cover 21. Connection or disconnection of the thermal head 12 and the connector unit 22 occurs with the motion of the head bracket.

(6-7) Modified Example 7

The following describes Modified Example 7. Modified Example 7 describes an example, in which a connecting board moves with the rotation of the head cover, the connecting board being connectable to the thermal head.

Figure 16:
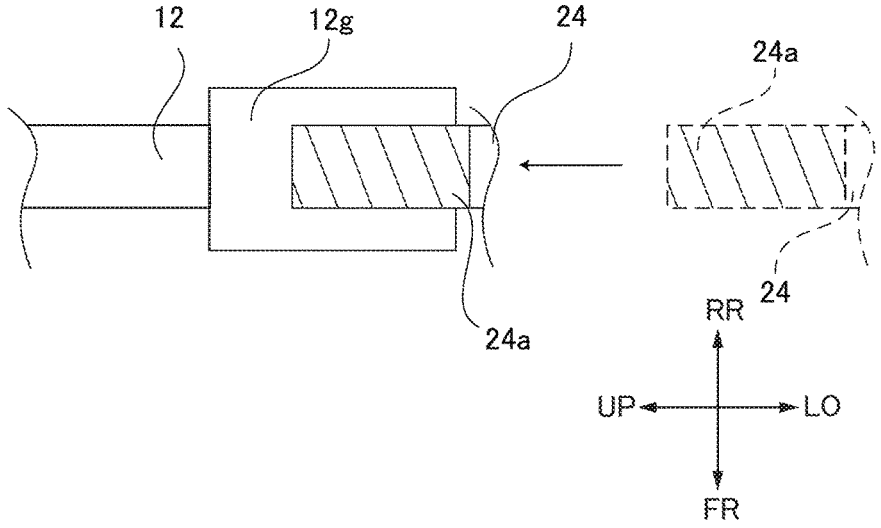
FIG. 16 schematically shows Modified Example 7 of the present embodiment.

FIG. 16 schematically shows Modified Example 7 of the present embodiment.

As shown in FIG. 16, a connector 12*g* (one example of the first connector) is attached to the thermal head 12 of Modified Example 7.

The connecting board 24 (one example of the connecting part) can connect to the connector 12*g*. The connecting board 24 includes a connector 24*a* (one example of the second connector). The connector 24*a* protrudes upward (UP) from the connecting board 24.

The connecting board 24 converts the rotary motion of the head cover 21 into the motion of the connecting board 24 in the up-down direction (UP-LO direction) due to a configuration similar to that of FIG. 5, for example.

The rotation of the head cover 21 moves the connecting board 24 in the up-down direction (UP-LO direction). This results in connection or disconnection of the connecting board 24 and the connector 12*g*.

That is, the head cover 21 of Modified Example 7 moves the connecting board 24.

As described above, when the user moves the head cover 21 of Modified Example 7, connection or disconnection of the connector 12*g* as the connecting terminal of the thermal head 12 and the connector 24*a* as the connecting terminal of the printer body occurs. This enables connection or disconnection of the thermal head 12 and the connecting board 24 without touching the thermal head 12 and the connecting board 24. This facilitates for the user connect or disconnect of the thermal head 12 and the connecting board 24.

(7) Other Modified Examples

The following describes other modified examples.

The above embodiments exemplify the print medium P having the liner PM and the labels PL, and the print medium P is not limited to this. The print medium P may be a label PL without a liner PM, for example.

The above embodiments exemplify printing with the thermal head 12, and means for printing is not limited to the thermal head 12.

The present embodiment is applicable to printing using an ink ribbon as well.

That is detailed descriptions on the embodiments of the present invention, and the scope of the present invention is not limited to these embodiments. The above embodiments can be modified or changed variously without departing from the scope of the present invention. The above embodiments and modified examples can be combined.

REFERENCE SIGNS LIST

1: printer
2: front panel
2*a*: label ejection port
2*b*: liner ejection port
3: printer cover
4: touch panel display
6: container
8: housing
10: platen roller
12: thermal head
12*a*: thermal head body
12*aa*: lower end
12*b*, 12*g*: connector
12*c*: heater element
12*d*: connector unit limiter
12*da*: first limiter
12*db*: second limiter
12*e*: concave
12*f*: earth part
13: first assisting roller
14: second assisting roller
15: separator
16: first nip roller
17: second nip roller
20: head bracket
20*a*: convex
20*b*: protrusion
20*d*: head bracket body
21: head cover
21*a*: engaging part
21*b*: gear
22: connector unit
22*a*: connector
22*b*: abutting part
22*ba*: notch
22*c*: metal member
22*d*: guide
22*e*: connector board
22*f*: engagement hole
23: gear
24: connecting board
24*a*: connector

What is claimed is:

1. A printer, comprising:

a thermal head;

a connector capable of being connected to and disconnected from the thermal head; and a moving mechanism joined with the connector, the moving mechanism configured to move the connector to connect and disconnect the thermal head and the connector.

2. The printer according to claim 1, further comprising a holding part to hold the thermal head before the connector is moved.

3. The printer according to claim 2, further comprising an operation member joined with the moving mechanism, wherein the moving mechanism moves the connector in response to operation to the operation member.

4. The printer according to claim 3, wherein the operation member is a head cover of the thermal head or a lever.

5. The printer according to claim 3, further comprising:

a housing; and a printer cover that is rotatable relative to the housing, wherein the connector is configured to move relative to the printer cover, and the operation member is configured to rotate relative to the printer cover.

6. The printer according to claim 2, wherein the moving mechanism moves the connector in parallel with the thermal head to connect and disconnect the thermal head and the connector.

7. The printer according to claim 6, wherein the moving mechanism makes the connector slide.

8. The printer according to claim 7, further comprising a connection position limiter configured to limit a position of the connector in a moving direction thereof.

9. The printer according to claim 1, further comprising a holding part configured to hold the thermal head, wherein the moving mechanism moves the connector so that the connector moves toward the thermal head held by the holding part or so that the connector moves away from the thermal head held by the holding part.

10. The printer according to claim 9, further comprising an operation member joined with the moving mechanism, wherein the moving mechanism moves the connector in response to operation to the operation member.

11. The printer according to claim 10, wherein the operation member is a head cover of the thermal head or a lever.

12. The printer according to claim 10, further comprising:

a housing; and a printer cover that is rotatable relative to the housing, wherein the connector is configured to move relative to the printer cover, and the operation member is configured to rotate relative to the printer cover.

13. The printer according to claim 1, further comprising an operation member joined with the moving mechanism, wherein the moving mechanism moves the connector in response to operation to the operation member.

14. The printer according to claim 13, wherein the operation member is a head cover of the thermal head or a lever.

15. The printer according to claim 13, further comprising:

a housing; and a printer cover that is rotatable relative to the housing, wherein the connector is configured to move relative to the printer cover, and the operation member is configured to rotate relative to the printer cover.

16. The printer according to claim 1, wherein the moving mechanism moves the connector in parallel with the thermal head to connect and disconnect the thermal head and the connector.

17. The printer according to claim 16, wherein the moving mechanism makes the connector slide.

18. The printer according to claim 17, further comprising a connection position limiter configured to limit a position of the connector in a moving direction thereof.

19. The printer according to claim 1, wherein the connector is configured to move in a linear direction while being connected to and disconnected from the thermal head.

20. The printer according to claim 1, wherein the connector comprises a male connector.

21. The printer according to claim 1, wherein the connector comprises a female connector.

22. A printer, comprising:

a thermal head;

an operation member;

a connector capable of being connected to and disconnected from the thermal head; and a moving mechanism, operatively between the operation member and the connector, the moving mechanism configured to move the connector to connect and disconnect the thermal head and the connector in response to operation of the operation member;

wherein the connector and the operation member are configured to move relative to one another while the connector is connected to and disconnected from the thermal head.

23. The printer according to claim 22, further comprising a holding part to hold the thermal head before the connector is moved.

24. The printer according to claim 22, further comprising a holding part configured to hold the thermal head, wherein the moving mechanism moves the connector so that the connector moves toward the thermal head held by the holding part or so that the connector moves away from the thermal head held by the holding part.

25. The printer according to claim 22, wherein the operation member is a lever.

26. The printer according to claim 22, wherein the operation member is a head cover of the thermal head.

27. The printer according to claim 22, further comprising:

a housing; and a printer cover that is rotatable relative to the housing, wherein the connector is configured to move relative to the printer cover, and the operation member is configured to rotate relative to the printer cover.

28. The printer according to claim 22, wherein the moving mechanism moves the connector in parallel with the thermal head to connect and disconnect the thermal head and the connector.

29. The printer according to claim 28, wherein the moving mechanism makes the connector slide.

30. The printer according to claim 29, further comprising a connection position limiter configured to limit a position of the connector in a moving direction thereof.

31. The printer according to claim 23, wherein the operation member is a lever.

32. The printer according to claim 23, wherein the operation member is a head cover of the thermal head.

33. The printer according to claim 23, further comprising:

a housing; and a printer cover that is rotatable relative to the housing, wherein the connector is configured to move relative to the printer cover, and the operation member is configured to rotate relative to the printer cover.

34. The printer according to claim 23, wherein the moving mechanism moves the connector in parallel with the thermal head to connect and disconnect the thermal head and the connector.

35. The printer according to claim 34, wherein the moving mechanism makes the connector slide.

36. The printer according to claim 35, further comprising a connection position limiter configured to limit a position of the connector in a moving direction thereof.

37. The printer according to claim 24, wherein the operation member is a lever.

38. The printer according to claim 24, wherein the operation member is a head cover of the thermal head.

39. The printer according to claim 24, further comprising:

a housing; and a printer cover that is rotatable relative to the housing, wherein the connector is configured to move relative to the printer cover, and the operation member is configured to rotate relative to the printer cover.

40. A printer, comprising:

a thermal head;

a connector capable of being connected to and disconnected from the thermal head; and teeth, operatively coupled to the connector, configured to move the connector to connect and disconnect the thermal head and the connector.

* * * * *